US005099589A

United States Patent [19]

Lai

[11] Patent Number: 5,099,589

[45] Date of Patent: Mar. 31, 1992

[54] PICTURE FRAME COMBINATION

[76] Inventor: Hsueh-Chen Lai, P.O. Box 1750, Taichung, Taiwan

[21] Appl. No.: 740,135

[22] Filed: Aug. 5, 1991

[51] Int. Cl.[5] ..... G09F 1/12

[52] U.S. Cl. ..... 40/152.1

[58] Field of Search ..... 40/152, 152.1, 156, 40/602, 120, 493; 248/139, 169, 188

[56] References Cited

U.S. PATENT DOCUMENTS

| | | | |
|---|---|---|---|
| 642,576 | 2/1900 | Boydell | 40/152 X |
| 1,358,534 | 11/1920 | Finch | 40/152 X |
| 1,436,544 | 11/1922 | Starr | 40/152.1 |

FOREIGN PATENT DOCUMENTS

| | | | |
|---|---|---|---|
| 592968 | 10/1947 | United Kingdom | 40/152 |

*Primary Examiner*—Kenneteh J. Dorner
*Assistant Examiner*—J. Bonifanti

[57] ABSTRACT

A picture frame including a body, a pair of wall members formed along an inner periphery of the body and separated with each other so that a gap is formed between the wall members, a slot formed in the top of the body so that pictures can be inserted into the gap and can be maintained in place by the wall members, a base including a pair of legs pivotally coupled to the bottom of the body and rotatable to either side of the body and arranged such that the body can be maintained in an upstanding position, and so that either side of the body can be shown.

1 Claim, 5 Drawing Sheets

PICTURE FRAME COMBINATION

BACKGROUND OF THE INVENTION

1. Field of the Invention

The present invention relates to a frame, and more particularly to a picture frame combination.

2. Description of the Prior Art

Various kinds of picture frames have been developed, in which one of the picture frame is disclosed in U.S. Pat. No. 1,448,024 to Brizgis, filed Aug. 18, 1922, entitled "SUPPORT FOR PICTURES OR THE LIKE". Another picture frame is disclosed in U.S. Pat. No. 3,074,680 to Stewart, filed Sept. 7, 1960, entitled "COMBINATION PICTURE FRAME STAND AND HANGER". In both picture frames, there is only one side is available, i.e. only one picture or the like can be disposed within each of the picture frames.

The present invention has arisen to mitigate and/or obviate the afore-described disadvantages of the conventional picture frames.

SUMMARY OF THE INVENTION

The primary objective of the present invention is to provide a picture frame combination in which both sides thereof are available so that two pictures can be disposed therein together.

In accordance with one aspect of the invention, there is provided a picture frame including a body which is a parallelogram including a top and a bottom in parallel with each other, a pair of wall members formed along an inner periphery of the body and separated with each other so that a gap is formed between the wall members, a slot formed in the top of the body so that pictures can be inserted into the gap and can be maintained in place by the wall members, a base including a pair of legs pivotally coupled to the bottom of the body, and the base being rotatable to either side of the body and being arranged such that the body can be maintained in an upstanding position, and so that either side of the body can be shown.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
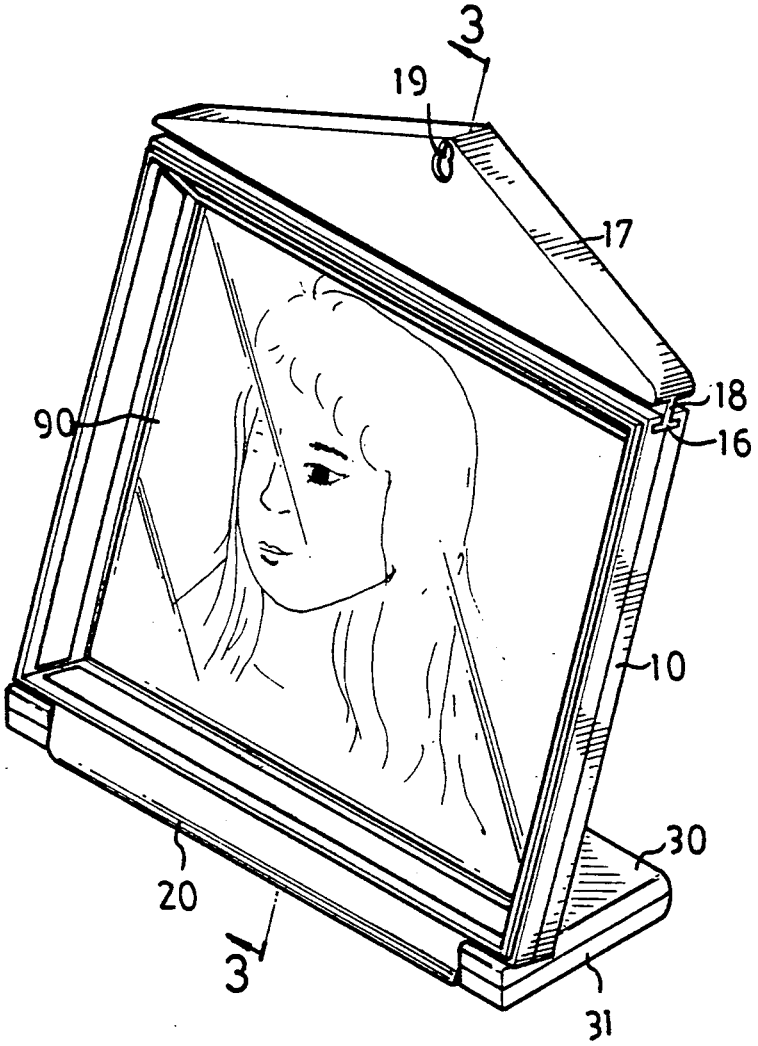
FIG. 1 is a perspective view of a picture frame combination in accordance with the present invention.
Figure 2:
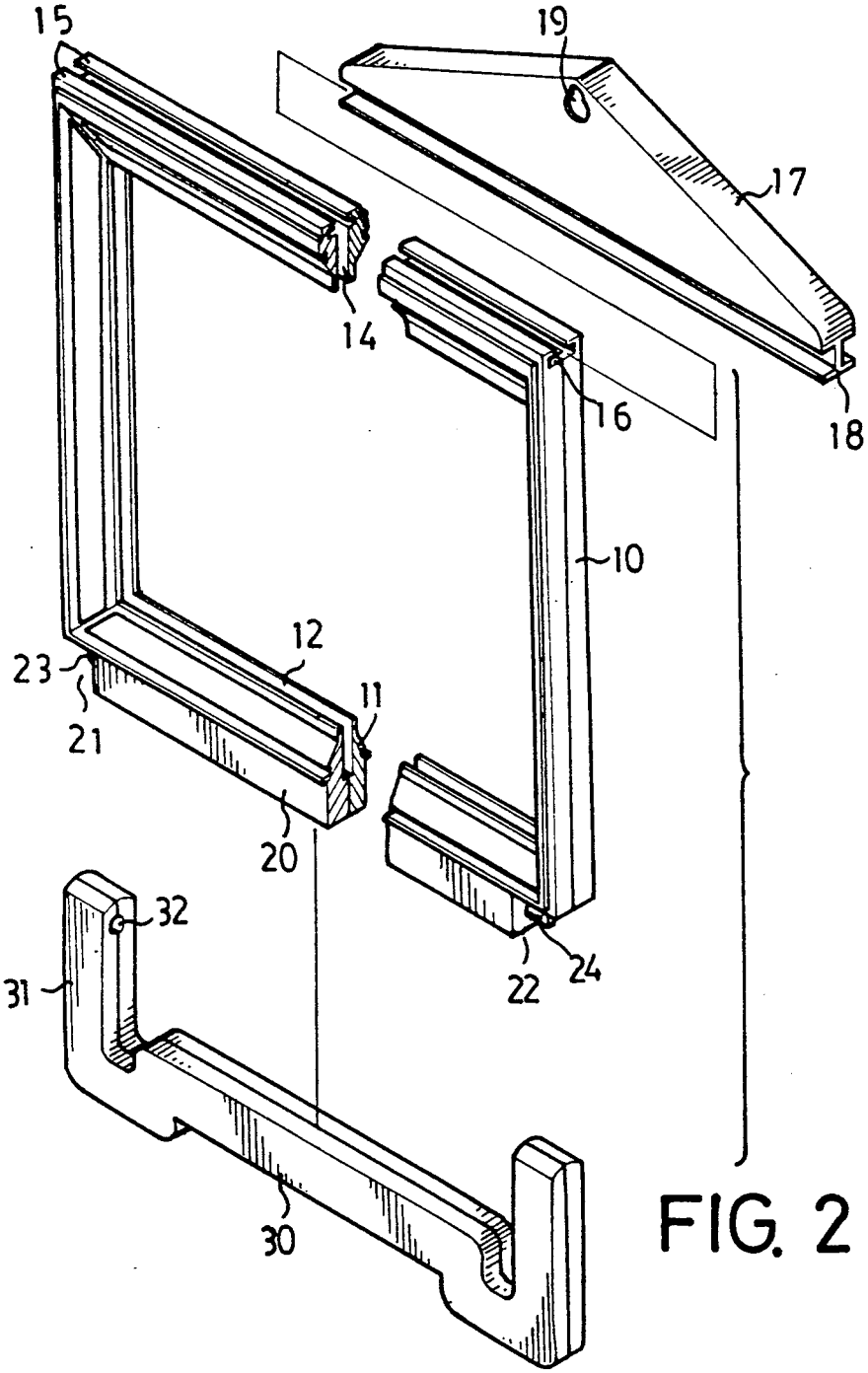
FIG. 2 is an exploded view of the picture frame combination.
Figure 3:
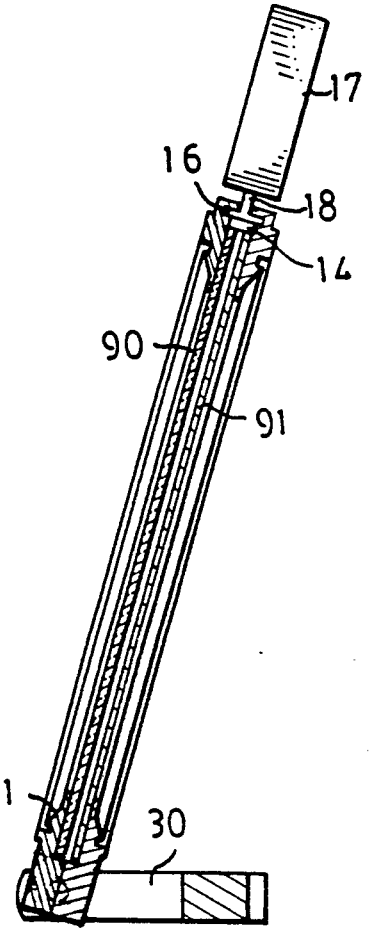
FIG. 3 is a partial cross sectional view of the picture frame combination taken along lines 3—3 of FIG. 1.

Referring to the drawings and initially to FIGS. 1, 2 and 3, a picture frame combination in accordance with the present invention comprises generally a body 10 which is substantially a parallelogram including a pair of wall members 11 formed along an inner periphery thereof and separated with each other so that a gap 12 is formed between the wall members 11. The wall members 11 are substantially wedge shaped and are preferably mirror symmetric with each other. A slot 14 is formed in the top of the body 10 so that the pictures 90, 91 or photographs or calendars or similar printing materials can be inserted into the gap 12 via the slot 14 and can be maintained in place by the wall members 11. A pair of flanges 15 are integrally formed in parallel along the top of the body 10 so that a female engaging means, such as a channel 16 is formed therebetween.

Figure 5:
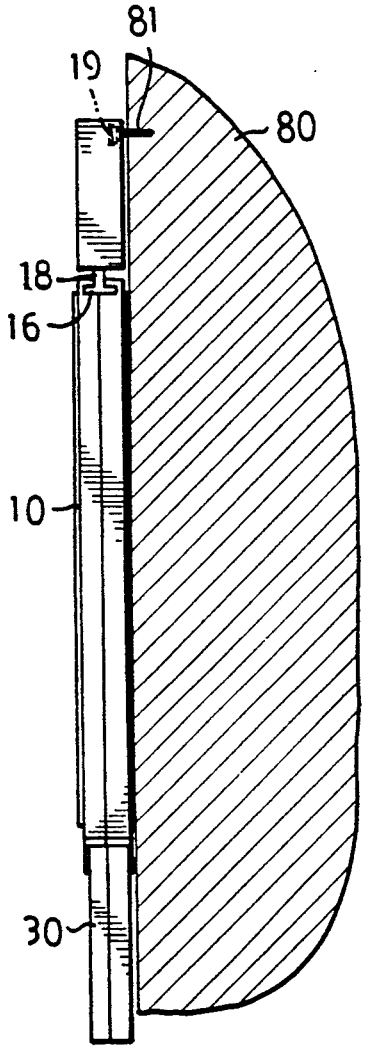
FIG. 5 is a schematic view of the picture frame combination illustrating another application thereof.

A member 17 is substantially triangular and includes a male engaging means, such as an inverted T-shaped beam 18 engageable in the channel 16 of the body 10 and maintained in place by such as force-fitted engagement. The beam 18 of the member 17 can be used as a cap for confining the pictures 90, 91 within the gap 12. In addition, advertisement or trademarks can be printed on either side of the member 17. A key hole 19 is formed in the upper portion of the member 17 so that the body 10 and the member 17 can be hung onto a nail 81 or the like which is fixed on the wall 80, as shown in FIG. 5, so that the member 17 can be used as a hanger.

The body 10, as shown in the drawings, is preferably a two part body including two halves fixed together by such as ultrasonic welding processes. The body 10 includes a bar 20 formed integral on the bottom thereof which has a length shorter than the width of the body 10 so that a notch 21, 22 is formed in each end portion of the bar 20. An axle 23, 24 is fixed to each end of the bar 20.

Figure 4:
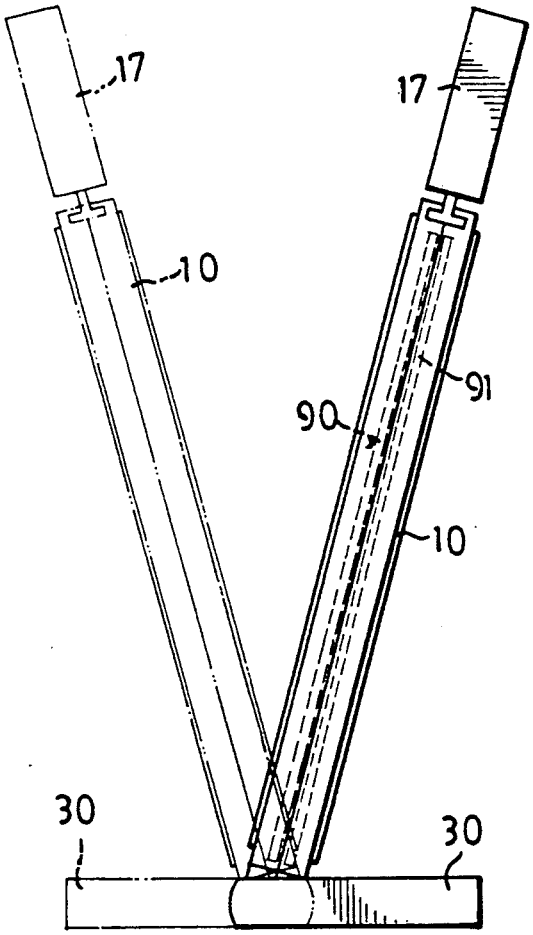
FIG. 4 is a side elevational view of the picture frame combination illustrating the operations thereof.

A base 30 is substantially U-shaped including a pair of legs 31 each having a cavity 32 formed in the upper portion of the inner surface thereof. The legs 31 of the base 30 can be slightly pulled outward so that the axles 23, 24 can be engaged in the cavities 32 of the legs 31 of the base 30 respectively and so that the base 30 can be rotatably coupled to the body 10. The axles 23, 24 form a rotational axis about which the base 30 can be rotated. As shown in FIGS. 3 and 4, when the base 30 is rotated to either side of the body 10, the body 10 can be maintained in a substantially upstanding position and is slightly inclined relative to a vertical axis so that either of the pictures 90, 91 can be shown.

Accordingly, both sides of the picture frame combination in accordance with the present invention are available so that either of the two pictures disposed within the body 10 can selectively be shown.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A picture frame combination comprising a body which is substantially a parallelogram including a top and a bottom which are substantially in parallel with each other, a pair of wall members formed along an inner periphery of said body and separated with each other so that a gap is formed therebetween, a slot formed in said top of said body so that pictures can be inserted into said gap and can be maintained in place by said wall members; a base including a pair of legs pivotally coupled to said bottom of said body, said body being a two part body including two halves integrally fixed together, said body including a bar formed integral on said bottom thereof, said bar having a length shorter than a width of said body so that a notch is formed in each end portion of said bar, an axle being fixed to each of said end portions of said bar and being located within a respective notch, each of said axles being rotatably engaged in a respective leg of said base so that said base can be pivotally coupled to said body; and said base being rotatable to either side of said body and being arranged such that said body can be maintained in an upstanding position, and so that either side of said body can be shown.

* * * * *